US005671571A

United States Patent [19]

Braun

[11] Patent Number: 5,671,571

[45] Date of Patent: Sep. 30, 1997

[54] PLASTERING AND LINING STRIP FOR WINDOW STILES, DOOR STILES OR THE LIKE AT THE TRANSITION TO THE PLASTER

[76] Inventor: August Braun, Theresienstrasse 36, 66440 Blieskastel, Germany

[21] Appl. No.: 295,632

[22] PCT Filed: Feb. 25, 1993

[86] PCT No.: PCT/EP93/00440

§ 371 Date: Dec. 8, 1994

§ 102(e) Date: Dec. 8, 1994

[87] PCT Pub. No.: WO93/17204

PCT Pub. Date: Sep. 2, 1993

[30] Foreign Application Priority Data

Feb. 26, 1992 [DE] Germany ..... 42 05 927.5

[51] Int. Cl.[6] ..... E06B 1/34; E06B 1/62

[52] U.S. Cl. ..... 52/211; 52/98; 52/100; 52/204.53; 52/254

[58] Field of Search ..... 52/85, 100, 204.53, 52/211, 254, 364, 366, 98

[56] References Cited

U.S. PATENT DOCUMENTS

| | | | |
|---|---|---|---|
| 1,264,787 | 4/1918 | Gude, Jr. | 52/366 |
| 1,782,147 | 11/1930 | Merryweather | 52/85 |
| 2,311,345 | 2/1943 | Mitchell | 52/85 X |
| 5,022,212 | 6/1991 | Lippolt | 52/254 X |
| 5,073,430 | 12/1991 | Aidan | 52/254 X |

FOREIGN PATENT DOCUMENTS

| | | | |
|---|---|---|---|
| 377816 | 5/1981 | Austria . | |
| 2151964 | 4/1973 | France . | |
| 2488308 | 2/1982 | France | 52/366 |
| 8715604 | 2/1988 | Germany . | |
| 9107334 | 10/1991 | Germany . | |
| WO89/04897 | 6/1989 | WIPO . | |

*Primary Examiner*—Carl D. Friedman
*Assistant Examiner*—Kevin D. Wilkens
*Attorney, Agent, or Firm*—Spencer & Frank

[57] ABSTRACT

A plastering and lining strip includes a first strip portion extending in a longitudinal direction, and that includes a base strip extending in the longitudinal direction. The base strip is defined by front and rear oppositely located sides, and two oppositely located edge faces connecting the front and rear sides together. The plastering and lining strip includes a web affixed to and projecting away from the front side and extending in the longitudinal direction. The web is positioned at a distance away from a selected one of the edge faces to form a plaster receiving space having an L-shaped cross section as viewed in the longitudinal direction. A region of the base strip extending from the selected one edge face to the web forms a spacing extension that constitutes a leg of the L-shaped cross section. The spacing extension has a width essentially corresponding to a thickness of an applied finish layer of plaster. The spacing extension has a diminished thickness at the selected one edge face whereby, when the plaster receiving space is filled with the plaster, the spacing extension is essentially completely covered. A protective cover plate extends essentially parallel to the first strip portion. A breakable material bridge removably connects the protective cover plate to the base strip in an area of the selected one edge face.

19 Claims, 3 Drawing Sheets

PLASTERING AND LINING STRIP FOR WINDOW STILES, DOOR STILES OR THE LIKE AT THE TRANSITION TO THE PLASTER

BACKGROUND OF THE INVENTION

The invention relates to a plastering and lining strip for window stiles, door stiles or the like at the transition to the plaster, having the following features:

(a) the strip has a base region which is provided on its rear side with an adhesive strip for securing the strip to the window stile, door stile or the like;

(b) the strip has at least one web which projects away from the front side of the base region and extends along the strip;

(c) a strip-shaped protective cover plate is provided which is connected to the base region of the strip by a breakoff material bridge of small thickness.

A strip of this type is known from DE 87 15 604 U.

In the construction of buildings, the typical procedure is to insert window stiles and door stiles (these are the stationary window frames or door frames which are permanently connected to the building) into corresponding wall openings of the shell and secure them there. In a later phase, the shell is plastered outside and inside. The connection of the plaster to the window stile or door stile is a critical juncture, particularly on the outside of the shell, because the plaster adjoins the material of the window stile or door stile (normally wood, plastic or metal) on the front side, and does not enter into a perfect bond there. Because the plaster shrinks slightly during drying, and because window stiles and door stiles are exposed to jarring, for example when the windows or doors are slammed shut, the danger exists that a crack or split will form between the plaster and the window stile or door stile. Then moisture can enter, which damages the window stile or door stile, and/or damages the plaster over time, for example resulting in crumbling of the plaster. Moreover, during plastering it is inevitable that plastering material is sprayed around. Plaster splashes can only be removed from the window stiles or door stiles with difficulty, if at all. This is arduous and time-consuming work; specks are frequently left behind.

These problems are solved with the above-mentioned, known plastering and lining strip. Prior to plastering of the shell, these strips are adhered along the left edge of the window stile or door stile, along its right edges and along its upper edge, and, occasionally—depending on the window sill construction—along the lower edge of the window stile or door stile. A film that spans the window surface or door surface inside the strips is adhered to the protective cover plates. In this way the affected window stile or door stile is perfectly protected against the accumulation of spraying plaster. The plaster ends at the strip material, allowing this connection to remain tight permanently. The elastic adhesive strip, which acts at the same time as a sealing strip, causes a decoupling of the jarring between the window stile or door stile and the strip with the plastering connected to the strip.

An aspect of the plastering and lining strips known up to now that is perceived as disadvantageous is that the web projecting away from the front side of the base region and typically lying approximately parallel to the wall surface to be plastered (or, if two webs are present, the web further away from the wall to be plastered) remains visible after plastering, because the flat side of the web which is further away from the wall to be plastered is used as a drawing-off edge during plastering, and—in the viewing direction of the plastered wall, at a right angle to the plastered wall surface—the plaster ends at the free end face of the web (even if—in this viewing direction—the plaster extends further in the direction of the window stile or door stile, behind the web).

SUMMARY OF THE INVENTION

The object of the invention is to make available a plastering and lining strip of the type mentioned at the outset which is considerably less visible after the application of the plaster.

To accomplish this object, in accordance with the invention, the strip is characterized in that (d) the base region of the strip has a strip-shaped spacing extension between the protective cover plate and the web, or—in the case of a plurality of webs—between the protective cover plate and the web closer to the protective cover plate, (e) with a receiving space for the plaster which has an essentially L-shaped cross-section being formed by the spacing extension and the named web; and (f) the spacing extension—viewed from the side when the protective cover plate is broken off—has such an end thickness that when the plaster is inserted into the plaster-receiving space, the strip material is completely or nearly completely covered.

By being covered, the strip is nearly invisible. Of course, the adhesive strip can still be seen when looked at carefully from certain viewing angles, but this is essentially less visually disturbing than the previously visible, normally several mm high web of the strip. Color contrasts between the material of the strip and the window stile or door stile and the plastering are no longer visually apparent. In addition to these aesthetic advantages, a resulting advantage is that the strip material is no longer exposed to UV radiation, and therefore will assuredly not be subjected to aging, color changes or the like. Consequently, a plastic which is slightly less favorable in terms of the mentioned aging aspect, but which is environmentally friendly and/or recyclable, can be chosen for the strip.

The simplest option of creating the described small end thickness of the spacing extension lies in configuring the spacing extension to have the smallest possible overall material thickness. However, limits have been placed on this configuration by the minimum stability of the spacing extension to be maintained.

In a refinement of the invention, it is preferred for the spacing extension (assuming a larger material thickness) to transition into the small end thickness by being rounded, chamfered or chamfered and rounded.

According to a further preferred embodiment of the invention, the strip has a second web which projects away from the front side of the base region and extends along the strip, and is further away from the protective cover plate than the first web and is spaced from the first web. This refinement serves in the inner connection between the plaster and the strip, because the second web is embedded in the under coating.

Preferably, the first web and/or the second web is preferably undercut such that a movement of the plaster away from the front side of the base region is prevented by a positive fit. Shrinkage of the plaster during drying no longer leads to a detachment of the plaster from the strip. The transition between the plaster and the strip is kept free from cracks and rain-proof.

A further preferred possibility of improving the bond between the plaster and the strip is for the first web and/or the second web to have perforations so that the plaster passes through the web or webs. It is emphasized that the presence of perforations in the first web represents an invention in its own right which can also be realized independently of the feature of the spacing extension. It is favorable when, in some of the perforations or in all of the perforations, the edges of the perforations are aligned with the front side of the base region in their rear region. Because of this, these aligned regions are free from burrs that could prevent perfect introduction of plaster into the perforations.

The perforations can, for example, be created by means of stamping or by pushing a punching tool through the web. Continuous production is possible by means of, for example, a rotating tool that has punching dies along its circumference.

It is preferred when the protective cover plate has a spacing web on its rear side which extends along the protective cover plate and preferably has such a height that it essentially ends in one plane with the rear side of the adhesive strip. The spacing web ensures that the protective cover plate is at a distance from the window stile or door stile, so that it can be comfortably grasped from below with the fingers following plastering work and broken off by being bent upwards. In some cases, it is advantageous to lightly score the break-off material bridge prior to this breaking off of the protective cover plate. Moreover, the spacing web prevents the protective cover plate from yielding too much toward the back when a protective film is adhered, and hindering the adhesion of the protective film. It is clear from the description of the functions of the spacing web that the intended effects are also achieved when its height differs from the described, preferred height.

As already indicated above, it is preferred when the protective cover plate has an adhesive strip on its front side for fastening a protective film which spans the window surface or door surface. Of course, the adhesive layer is preferably provided with an easy-to-remove cover strip when delivered.

The spacing extension preferably has a width that essentially corresponds to the thickness of an upper finish layer to be applied. In this case, as with the known strips, the flat side of the web facing away from the wall to be plastered, or—in the case of two webs—the flat side of the web adjacent to the protective cover plate can be used as the drawing-off edge in the application of the under coat. Afterward the upper finish is applied, which extends into the plaster-receiving space essentially in an L-shape. In this instance, the free edge of the spacing extension can be used as an orientation aid or as the drawing-off edge.

Plastering and lining strips are already known with which a reinforcing piece of fabric is connected, or which have a device for clamping a reinforcing fabric to be embedded into the plaster. These strips are intended for use in buildings provided with so-called full thermal protection. In full thermal protection, an insulating layer, e.g. of foamed polystyrene plates or of a fibrous material, is applied to the outside, on the outside walls of the building, and the plaster is applied to the outside of this insulating layer. To reliably prevent crack formation in the plaster layer, a reinforcing fabric is normally first applied to the insulating layer and held, for example, by a filler mass. In most cases, the reinforcing fabric is made of a mesh-type plastic product. Plastering and lining layers having pieces of reinforcing fabric serve in also making reinforcing fabric available on the insulating layer in the region of the window molding or door molding.

According to a preferred modification of the invention, the strip of the invention is connected to a piece of reinforcing fabric when delivered, or the strip of the invention has a device for clamping a reinforcing fabric to be embedded into the plaster. A preferred possible embodiment for the clamping device includes a strip-shaped clamping plate which is connected to the strip by way of a bendable material bridge and is snapped in the clamped position with its edge behind a strip projection. It is emphasized that this embodiment of the clamping device is only one of many possibilities. Alternatively, in particular one can provide an undercut clamping conduit into which an edge of the piece of reinforcing fabric can be inserted, whereupon the conduit is sealed by a snapped-in closure piece which securely clamps the piece of reinforcing fabric in the conduit. The conduit can, for example, have the shape of an approximately three-quarter circle, and the closure piece can be a round rod. According to a further alternative, it is possible to connect the piece of reinforcing fabric permanently with the strip not by clamping, but in some other way.

The strip of the invention is preferably made of plastic. Polyvinyl chloride and polyethylene are primarily considered. The strip can be produced cost-effectively in an extrusion method. Alternatively, it is possible to produce the strip from metal.

BRIEF DESCRIPTION OF THE DRAWINGS

The invention and embodiments of the invention are described in more detail below in conjunction with embodiments shown in the drawings. Shown are in.

DETAILED DESCRIPTION OF THE INVENTION

Figure 1:
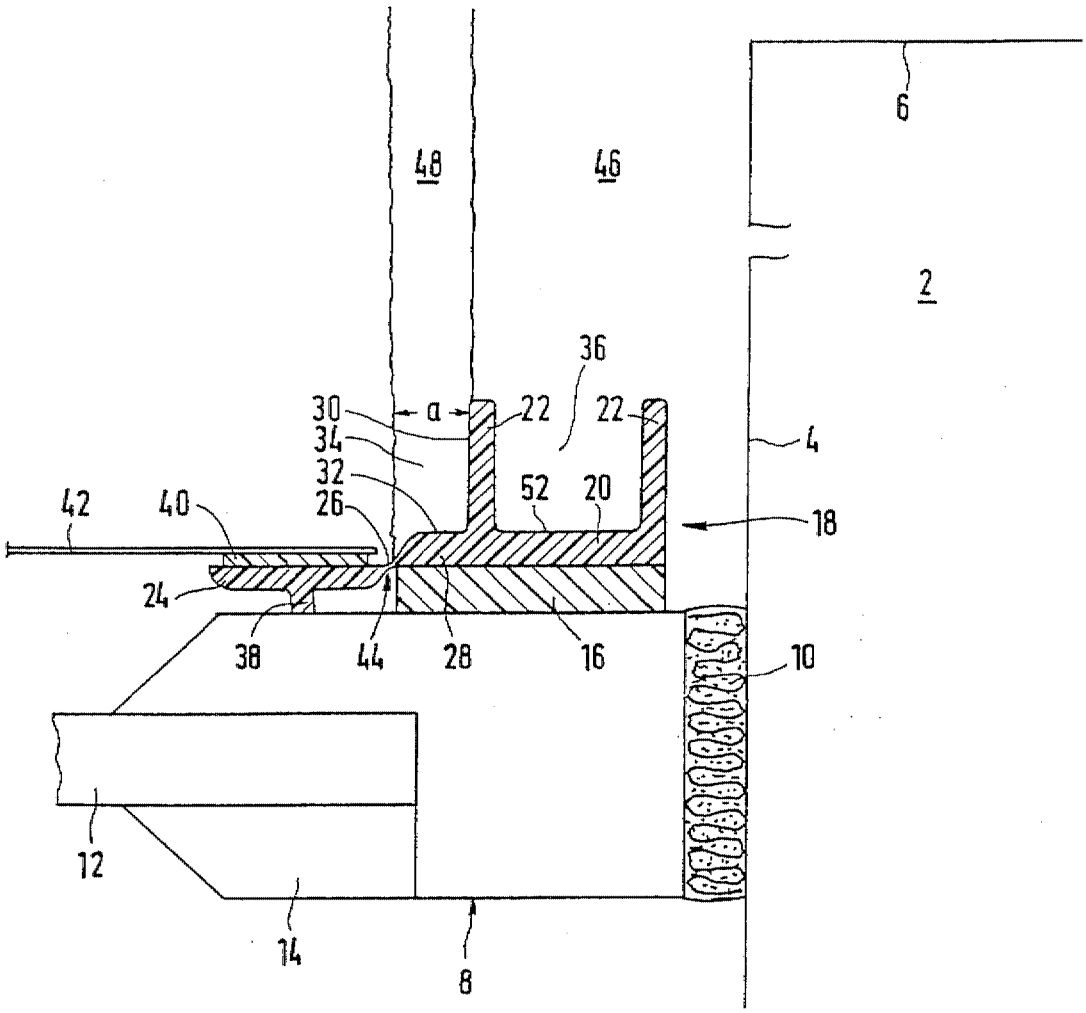
FIG. 1 a strip in cross-section, adhered to a window stile or door stile, after application of the wall plaster.

FIG. 1 is a horizontal cross-section through a part of a house wall 2, which can comprise, for example masoned stones or concrete. The outside of the house is shown at the top of the drawing page, in FIG. 1, and the inside of the house is shown in FIG. 1, at the bottom of the drawing page. The boundary line extending from top to bottom is the molding 4; the boundary line of the wall 2 extending horizontally represents the outer surface 6 of the unplastered wall 2. Much further to the left of the edge of FIG. 1, a wall section should be envisioned which is identical in mirror image, so that the two molding surfaces 4 define both sides of a wall opening.

A window stile 8 is secured in the wall opening, and the joint between the outside of the window stile 8 and the moldings 4 is filled with hardened polyurethane foam 10. A window pane 12, preferably a double pane, is secured in the window stile 8 by means of a block strip 14 which is placed in front of it later. The window pane 12 is therefore fixed. In the case of a window wing that can be opened, the pane 12 is not seated directly in the window stile 8, but in a window frame that can be opened and is secured to the window stile 8 with hinges.

A plastering and lining strip 18, hereinafter referred to as "strip 18" for short, is adhered to the outside of the window stile 8 by means of an adhesive strip 16. The adhesive strip 16 comprises foamed plastic of high firmness which is elastically yielding, but has a relatively high compression resistance. The adhesive strip 16 serves simultaneously as a sealing strip.

Aside from the adhesive strip 16, the strip 18 essentially comprises a base region 20, two webs 22 and a protective cover plate 24. The base region 20 has a level rear side (bottom of FIG. 1), to which the adhesive strip 16 is adhered. Two webs 22 project away from the front side (top of FIG. 1) of the base region 20 at a right angle. The two webs 22 are respectively defined by two parallel surfaces and by a front face at the free end. The outer surface of the right web 22 in FIG. 1 changes over flush into the side end of the base region 20.

The left web 22 in FIG. 1 is at a lateral distance a from the left face end 26 of the base region 20 in FIG. 1. This left face end 26 is located on the side of the strip 18 facing away from the molding 4. The extension of the base region 20 toward the left, beyond the position of the left web 22, is designated as spacing extension 28. An essentially L-shaped plaster-receiving space 34 is thus defined by the left flat side 30 of the left web 22 and the front surface 32 of the spacing extension 28.

The web 22 on the left in FIG. 1 is designated as "first web", while the web 22 on the right in FIG. 1 is designated as "second web."

An essentially U-shaped plaster-receiving space 36 is defined by the inner flat sides of the two webs 22 and the front side of the base region 20. The right web 22 is located at a distance from the molding 4. Depending on the width of the window stile 8, however, the strip 18 could also be adhered such that the right web 22 is seated closely to the molding 4.

The strip-shaped protective cover plate 24 adjoins the side end 26 of the base region 20. The front side of the protective cover plate 24 is configured to be level, and is located essentially in the extension of the rear side of the base region 20. On its rear side, the protective cover plate 24 has a spacing web 38 that projects toward the back at essentially a right angle. The spacing web 38 is so high that the protective cover plate 24 is supported against the window stile 8 by the spacing web 38 such that the front side of the protective cover plate 24 is essentially parallel to the front side of the window stile 8, i.e., spacing rib 38 has a height extending to a plane in which a rear face of adhesive strip 16 is located.

The protective cover plate 24 has an adhesive layer on its front side. A protective film 42 that extends to the left from the strip 18 in FIG. 1 is adhered to this layer. The protective cover plate 24 is connected to the spacing extension 28 by way of a break-off material bridge 44.

It is emphasized that the cross-section of the strip 18, including protective cover plate 24, is constant over its entire length, so the strip 18 can be produced without problems by means of extrusion.

It can be seen in FIG. 1 that a under coat 46 is applied to the molding 4 with such a thickness that the right web 22 is embedded in the under coat 46, and that the under coat 46 essentially ends flush with the left flat side of the left web 22. Thus, the flat side 30 can be used as a drawing-off edge when the under coat 46 is rubbed smooth. A layer of upper finish 48 is applied on the under coat 46 with essentially the thickness of dimension a. The side end 26 of the spacing extension 28 can serve as the drawing-off edge when the upper finish 48 is rubbed smooth.

After plastering has been completely finished, the protective film 42 is removed, and the protective strip 24 is broken off at the break-off material bridge 44. Because the thickness of the spacing extension 28 transitions into a minimal end thickness at the side end of the spacing extension by being rounded—assuming a thickness corresponding to the thickness of the base region 20—only a very narrow strip of material of the lining strip material (with the exception of the adhesive strip 16) corresponding to the broken-off break-off material bridge 44 remains visible after the protective cover plate 24 has been broken off.

It is pointed out that the strip 18 is inserted in an analogous manner during plastering of door stiles.

Figure 2:
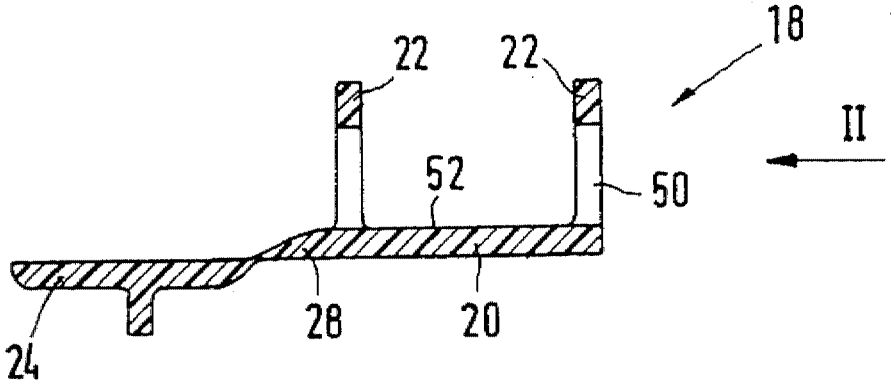
FIG. 2 a further embodiment of a strip in cross-section.
Figure 3:
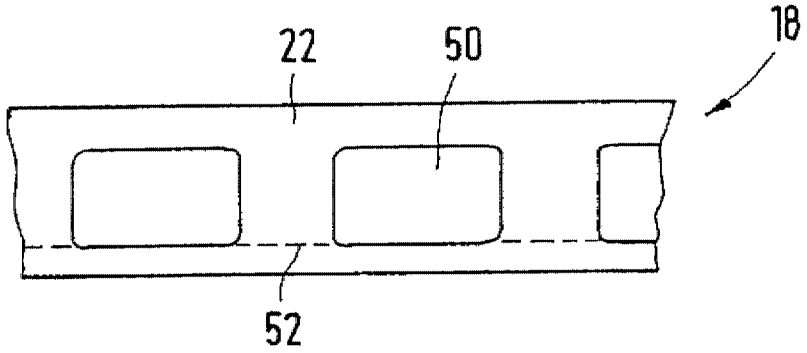
FIG. 3 a side view of the strip from FIG. 2 according to arrow II.

The strip 18 according to FIGS. 2 and 3 serves to illustrate a preferred modification measure. A row of perforations 50 is provided in each of the two webs 22. In the embodiment of FIG. 3, the perforations 50 are essentially rectangular with rounded-off corners, while in the embodiment of FIG. 4 the perforations 50 are essentially semi-circular. The rear regions of the edges of the perforations are aligned with the front side 52 of the base region 20.

Figure 4:
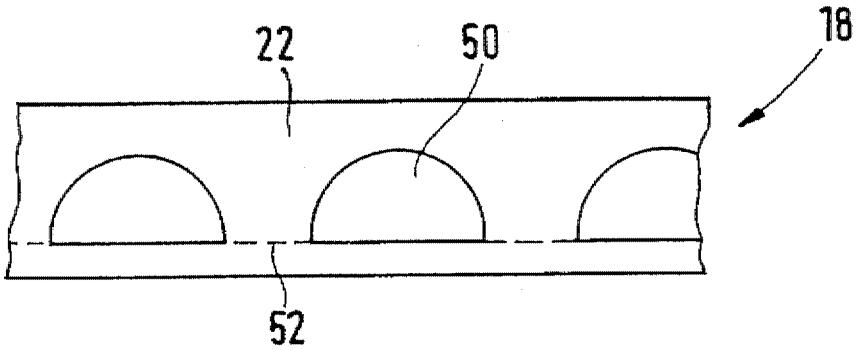
FIG. 4 a variation of the strip of FIGS. 2 and 3, in a side view as in FIG. 3.

The perforations 50 can also be provided in other shapes than those illustrated in FIGS. 3 and 4, e.g. square, circular, orbicular, etc. The rear regions of the edges of the perforations are aligned with the front side 52 of the base region 20. The shape of the perforations 50 can alternate along each web 22. The shape of the perforations can be different in the left web 22 and the right web 22. It is possible to provide only one of the two webs 22 with perforations 50.

FIG. 2 further serves to illustrate a variation of the transition of the thickness of the spacing extension 28 to the smallest possible end thickness by means of chamfering.

Figure 5:
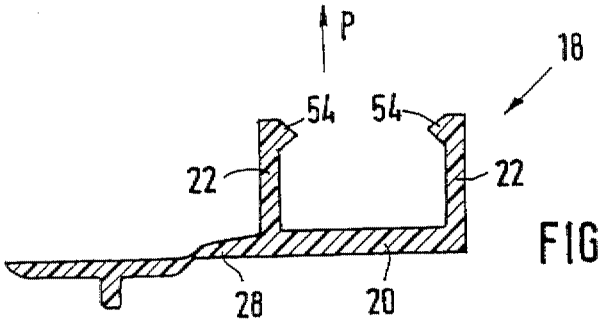
FIGS. 5 through 7 three further embodiments of a strip in cross-section.
Figure 6:
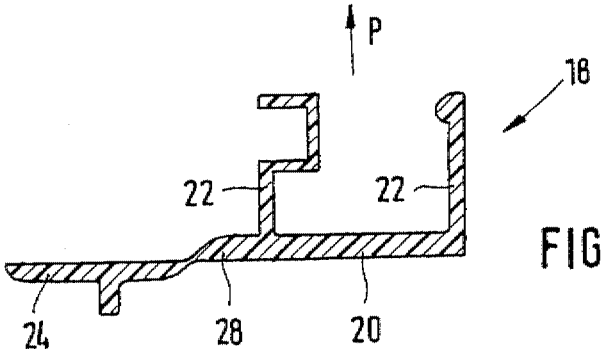
Figure 7:
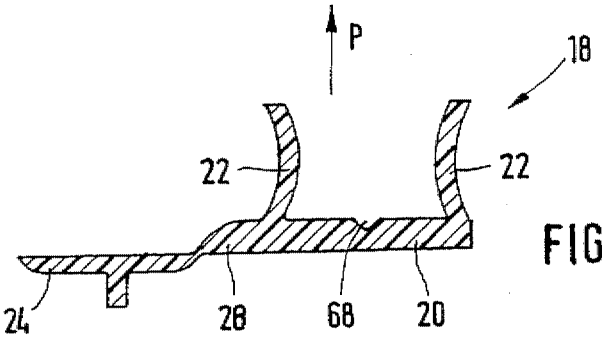

In FIGS. 5 through 7, embodiments of the strip 18 are illustrated in which the two webs 22 are shaped such that an undercutting is formed respectively on the left side of the right web 22 and/or on the right side of the left web 22, and/or on the left side of the left web 22. These undercuttings prevent movements of the plaster away from the front side of the base region 20 of the strip 18 in the direction of the arrow P.

In the embodiment according to FIG. 5, the two webs 22 each have an essentially triangular projection 54 in the vicinity of their face end whose cross-section is oriented inwardly. The projections 54 could also be more rounded-bead-shaped; see the right portion of FIG. 6.

In the embodiment according to FIG. 6, the left web 22 is crimped toward the inside at approximately half its height, then crimped again to extend in the original direction, and crimped toward the outside at the end. This results in an undercutting on the left web 22, both in the plaster-receiving space 36 and in the plaster-receiving space 34.

In the embodiment according to FIG. 7, the two webs do not extend in level fashion, but are arched in the sense that the plaster-receiving space 36 is at maximum narrowness at half the height of the strip 18, and becomes broader beyond this point. The plaster-receiving space 34 is at maximum width at half the height of the strip 18 and, in contrast, narrower at the front end of the strip 18. Alternatively, two arched webs 22 can be selected that have maximum spacing at approximately half the height of the strip 18, and minimum spacing at the front on the strip 18. Furthermore, it is possible to configure only one of the two webs 22 arched and the other of the two webs level.

It is pointed out that the embodiment features outlined by way of FIGS. 2 through 7 can also be combined with one another in other ways than in the illustrated embodiments. For example, the left web 22 of FIG. 6, which was crimped multiple times, can be combined with an arched right web. The essential point is the creation of functional undercuttings on the left side of the left web 22 (FIGS. 6 and 7) and/or on the right side of the left web 22 (FIGS. 5, 6, 7), and/or on the left side of the right web 22 (FIGS. 5, 6, 7) and/or the right side of the right web (FIG. 7). The undercutting measures can be different for the two webs 22, as illustrated—as an example—by FIG. 6.

To clarify the drawings of FIGS. 2 through 7, the adhesive strip 16 and the adhesive layer 40 are omitted.

It is further pointed out that the two webs 22 can have different heights, which differs from the illustrated embodiments.

Figure 8:
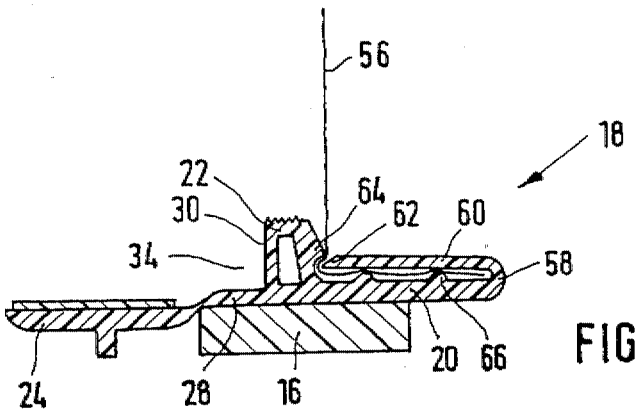
FIG. 8 a further embodiment of a strip in cross-section.

A strip 18 that is connected to a piece of reinforcing fabric 56 is represented in FIG. 8. This strip 18 has only one web 22. The base region 20 changes over into a strip-shaped clamping plate 60 with a bendable material bridge 58 of reduced thickness. The clamping plate 60 is bent back by approximately 180° relative to the base region 20, and its pointed end 62 is snapped or latched behind a projection 64 or catch of the web 22. On its front side 52, the base region 20 has two or more adjacent projections 66 extending along the strip 18. The edge of the piece of reinforcing fabric 56 is securely clamped between the front side 52 of the base region 20, particularly the projections 66, and the rear side of the bent-back clamping plate 60. The piece of reinforcing fabric 56 leads out of the strip 18 between the end 62 of the clamping plate 60 and the projection 64. As in the above embodiments, a plaster-receiving space 34 is defined by the left flat side 30 of the web 22 and the front side of the spacing extension 28. The side end of the spacing extension 28 is reduced to a minimal end thickness, as in the above embodiments.

In FIG. 7, a longitudinally-extending groove 68 is indicated in the front side 52 of the base region 20, approximately in the center between the two webs 22. The groove 68 serves as a centering aid in case one wishes to fix the strip 18 to the window stile or door stile. For this purpose, the strip 18 can also have spaced screw holes, for example in the groove 68, or in the absence of the groove 68. It will be understood that the groove 68 and/or the screw holes can be provided in all embodiments.

In all of the embodiments, the strip 18 is made of plastic or, alternatively, of metal.

Strips 18 can also be produced and sold with a different width a of the spacing extension 28, with the width matching the thickness of the respective upper finish 48 to be applied.

There are different types of upper finishes; they vary by the grain size of the sand or the like that they contain. The spacing extension advantageously has a width a that corresponds to the grain size of the upper finish to be used, or is slightly larger. A typical example is 3 mm. In this case one can readily press on the region of the plastering strip 18 when the upper finish is rubbed smooth, because the grains are supported against the left web 22.

Typical dimensions of the strips are:

| | |
|---|---|
| 10 to 40 mm | composite width of base region and spacing extension; |
| 5 to 40 mm | web height; |
| 0.5 to 3 mm | material thickness; |
| 8 to 15 mm | width of the protective cover plate; |
| 2.5 to 5.5 mm | thickness of the adhesive strip. |

Finally, it is emphasized that the strip according to the invention can not only be used at the transition from a window stile or door stile to wall plaster, but, in general, anywhere plaster is contiguous to a wooden, plastic or metal building component. A further example of this is beams exiting a wall.

Instead of being secured to the window stile 8 by means of the adhesive strip 16, the strip 18 could be secured, for example, by means of a strip of a self-adhering, permanently flexible sealing mass, preferably butyl rubber or a fusion adhesive ("hot melt") extending along the strip 18. In this respect the term "adhesive strip" used in the present application can be replaced by the general term "means of adhesive attachment."

I claim:

1. A plastering and lining strip, comprising:

a first strip portion extending in a longitudinal direction, said first strip portion including:

a base strip extending in the longitudinal direction, said base strip being defined by front and rear oppositely located sides, and two oppositely located edge faces connecting said front and rear sides together, said sides and said edge faces being essentially parallel to each other, said rear side being fastenable to a window or door stile; and a web affixed to and projecting away from said front side and extending in the longitudinal direction, said web being positioned at a distance away from a selected one of said edge faces to form a plaster receiving space having an L-shaped cross section as viewed in the longitudinal direction, with a region of said base strip extending from the selected one edge face to said web forming a spacing extension that constitutes a leg of the L-shaped cross section, said spacing extension having a diminished thickness at said selected one edge face whereby, when the plaster receiving space is filled with the plaster, said spacing extension is essentially completely covered;

a second strip portion comprising a protective cover plate extending essentially parallel to said first strip portion; and a breakable material bridge extending essentially parallel to said first strip portion and said second strip portion, and removably connecting said protective cover plate to said base strip in an area of the selected one edge face.

2. The plastering and lining strip defined in claim 1, wherein said spacing extension has a transition region that is tapered in a direction transverse to the longitudinal direction and toward the selected one edge face.

3. The plastering and lining strip defined in claim 2, wherein said transition region is rounded.

4. The plastering and lining strip defined in claim 2, wherein said transition region is chamfered.

5. The plastering and lining strip defined in claim 1, wherein said web constitutes a first web; further comprising a second web affixed to and projecting away from said front side and extending in the longitudinal direction, said second web being separated from said first web by a space so as to be positioned between said first web and the other edge face.

6. The plastering and lining strip defined in claim 5, wherein at least one of said webs has an undercut portion.

7. The plastering and lining strip defined in claim 5, wherein at least one of said webs includes means for preventing a movement of plaster away from the front side of said base strip.

8. The plastering and lining strip defined in claim 5, wherein at least one of said webs has a plurality of perforations therethrough.

9. The plastering and lining strip defined in claim 8, wherein at least one of said perforations has a rear edge in alignment with said front side of said base strip.

10. The plastering and lining strip defined in claim 1, wherein said protective cover plate has a rear side, and a spacing rib extending in the longitudinal direction affixed to the rear side of said protective cover plate.

11. The plastering and lining strip defined in claim 10, further comprising an adhesive strip attached to the rear side of said base strip.

12. The plastering and lining strip defined in claim 11, wherein said spacing rib has a height extending to a plane in which a rear face of said adhesive strip is located.

13. The plastering and lining strip defined in claim 1, wherein said first strip portion includes means for clamping a reinforcing fabric.

14. The plastering and lining strip defined in claim 13, wherein said means includes a clamping plate strip extending in the longitudinal direction, and a bendable material bridge connecting said clamping plate strip to said base strip, said clamping plate strip being positionable over said base strip, and having a free end engageable with a projection attached to said base strip to fix said means in a clamping position.

15. The plastering and lining strip defined in claim 1, wherein said protective cover plate has a front side, and an adhesive layer located on the front side of said protective cover plate for securing a protective film thereto.

16. The plastering and lining strip defined in claim 1, further comprising a reinforcing fabric connected to said first strip portion.

17. The plastering and lining strip defined in claim 1, wherein said plastering, and lining strip is comprised of a plastic material.

18. The plastering and lining strip defined in claim 1, further comprising an adhesive strip attached to said rear side of said base strip for fastening said rear side to the window or door stile.

19. The plastering and lining strip defined in claim wherein the spacing extension has a width essentially corresponding to a thickness of an applied finished layer of plaster.

* * * * *